US009452472B2

(12) United States Patent
Tsypine et al.

(10) Patent No.: US 9,452,472 B2
(45) Date of Patent: Sep. 27, 2016

(54) WEAR-RESISTANT CASTINGS AND METHOD OF FABRICATION THEREOF

(75) Inventors: Igor Tsypine, St-Laurent (CA); Rafael Perlin, Montréal (CA)

(73) Assignee: Igor Tsypine, St-Laurent (CA)

( * ) Notice: Subject to any disclaimer, the term of this patent is extended or adjusted under 35 U.S.C. 154(b) by 1141 days.

(21) Appl. No.: 12/532,276

(22) PCT Filed: Apr. 18, 2008

(86) PCT No.: PCT/CA2008/000720

§ 371 (c)(1),
(2), (4) Date: Sep. 21, 2009

(87) PCT Pub. No.: WO2008/128334

PCT Pub. Date: Oct. 30, 2008

(65) Prior Publication Data

US 2010/0143742 A1 Jun. 10, 2010

(30) Foreign Application Priority Data

Apr. 20, 2007 (CA) ..... 2585688

(51) Int. Cl.

| | |
|---|---|
| ***B21D 39/00*** | (2006.01) |
| ***B22D 19/00*** | (2006.01) |
| ***B22D 25/06*** | (2006.01) |
| ***C22C 37/06*** | (2006.01) |
| ***C22C 37/10*** | (2006.01) |

(52) U.S. Cl.

CPC ..... *B22D 19/00* (2013.01); *B22D 25/06* (2013.01); *C22C 37/06* (2013.01); *C22C 37/10* (2013.01); *Y10T 428/12389* (2015.01); *Y10T 428/12493* (2015.01); *Y10T 428/12951* (2015.01); *Y10T 428/12972* (2015.01)

(58) Field of Classification Search

USPC ..... 428/600, 615, 681, 684; 148/538; 524/589

See application file for complete search history.

(56) References Cited

U.S. PATENT DOCUMENTS

| | | | | |
|---|---|---|---|---|
| 1,926,770 | A | | 9/1933 | Harnis |
| 2,155,215 | A | * | 4/1939 | Beament ..... 148/522 |
| 3,607,607 | A | * | 9/1971 | Beninga et al. ..... 428/49 |
| 3,725,016 | A | * | 4/1973 | Mal et al. ..... 428/545 |
| 4,017,480 | A | | 4/1977 | Baum |
| 5,066,546 | A | | 11/1991 | Materkowski |
| 5,081,774 | A | | 1/1992 | Kuwano |
| 5,288,353 | A | * | 2/1994 | Revankar ..... 156/153 |
| 5,299,620 | A | * | 4/1994 | Revankar et al. ..... 164/97 |
| 5,328,776 | A | * | 7/1994 | Garber et al. ..... 428/614 |
| 6,171,713 | B1 | | 1/2001 | Smith et al. |

FOREIGN PATENT DOCUMENTS

| | | | |
|---|---|---|---|
| CA | 1 060 683 | | 8/1979 |
| CZ | 279637 | * | 5/1997 |

* cited by examiner

*Primary Examiner* — Daniel J Schleis
(74) *Attorney, Agent, or Firm* — Gwendoline Bruneau

(57) ABSTRACT

A wear resistant casting and method of fabrication thereof, the casting comprising inserts embedded in a matrix; each insert having a form such that a ratio A/B in any mutually perpendicular section that passes through the center of mass of the insert is comprised between 0.4 and 2.5, and a distance C between two insert is at least two times smaller that a width thereof; the inserts forming at least one grid.

21 Claims, 16 Drawing Sheets

WEAR-RESISTANT CASTINGS AND METHOD OF FABRICATION THEREOF

CROSS-REFERENCE TO RELATED APPLICATIONS

This application is a National Entry Application of PCT application no CA2008/000720 filed on Apr. 18, 2008 and published in English under PCT Article 21(2), which itself claims priority on CA application Serial No. 2,585,688, filed on Apr. 20, 2007. All documents above are incorporated herein in their entirety by reference.

FIELD OF THE INVENTION

The present invention relates to wear-resistant castings. More specifically, the present invention is concerned with wear-resistant castings and method of fabrication thereof.

BACKGROUND OF THE INVENTION

One of many challenges for manufacturer of machine parts that are subjected to intensive abrasive wear, especially in conditions where abrasion wear is combined with impact loads, is to ensure a satisfactory longevity of these particular machine parts. Usually additional considerations, such as the fixing technique of the liner and/or the maintenance facility, for example, are also to be taken to account.

Various technical solutions presently used in mining and similar industries to protect machine parts from wear are able to meet, to some degree, these requirements, by using materials that have good abrasive and/or impact resistance, design flexibility, and good weldability.

Austenitic steels with a 13% Mn by weight, for example, have very good toughness and strength and are used in extremely hard wear conditions, including impact wear conditions that occur for example in conical and jaw crushers, or in excavator teeth. However, these steels have a relatively low hardness (about 220 HB) and therefore a low abrasive resistance (see Metals Handbook, 10th edition, 1990, ASM International, Material Park, Ohio). Moreover, due to their poor weldability, they require special welding rods and higher welding time and general costs.

Hi-Cr cast irons, described for example in G. Laird, R. Gundlach, K. Rohrig. Abrasion-Resistant Cast Iron Handbook, AFS, Illinois, 2000, have very good hardness and abrasive wear resistance resulting from a microstructure comprising extremely hard chromium carbides dispersed in a martensite or martensite-austenite matrix. However, this increased hardness leads to a very low ductility and for this reason the use of these materials in impact intensive conditions is either counterproductive or limited. Moreover, these cast irons cannot be easily welded and, therefore, have to be fixed on the protected surface by bolting.

Another group of wear resistant materials comprises low carbon heat-treated steels like, for example, Hardox™, AR steel, Astralloy™. They have high strength, good toughness, and good hardness (up to 550 HB) while remaining weldable to a certain extent. As compared to ferrite and pearlite steels, they demonstrate an increased wear resistance, however, they are significantly inferior to Hi-Cr cast irons from a wear resistance point of view. Their microstructure lacks carbides or other phases comparable, from the hardness point of view, with the quartz, which is known as one of the widest spread wear causing components of all abrasive materials. Moreover, these steels can exclusively be used to cover flat surfaces, since they are produced by rolling methods.

There have been attempts to combine the properties of tough, ductile materials, such as steels, and highly wear resistant but brittle materials, like Hi-Cr cast irons, by laminating such materials together into one product. Brazed laminated plates consist of a massive Hi-Cr cast plate jointed with a mild steel under-plate by brazing. Such products combine the high wear resistance of Hi-Cr cast iron with the good weldability properties of mild steel. However the brittleness of the Hi-Cr cast iron reappears in the top part of this products and the brazed bond between two parts may fail. There are well reported cases where chunks of the Hi-Cr cast iron block were separated from the laminated plate, resulting in serious damages to the machinery down the production line and, consequently, significant downtimes. Moreover, brazed laminated plates cannot be manufactured to fit curved surfaces or to have a variable thickness.

Popular hard faced plates, such as provided by the company BROSPEC INC. for example, consist of mild steel flat bars covered by welding with alloys in which carbides are dispersed in a mainly austenitic matrix. These products have a good weldability but they inherit drawbacks from the automatic welding process used for their manufacturing. First, they may only be placed on flat surfaces. Secondly, the total thickness, even in multilayer product, is very limited (usually ½" up to ¾") by metallurgical reasons. Third, the wear resistant layer has high internal stresses due to a number of factors including high thermal gradient, different thermal coefficients of the mild steel and the alloy itself as well as high cooling speed. These stresses eventually cause cracking of the hard faced layer with subsequent crumbling of the layer. After welding, although the austenitic microstructure is far from being optimal, there is no possibility to improve it by heat treatment because of those internal stresses and the divergence of the mechanical properties.

Another group of technical solutions to increase the wear resistance of the machinery includes placing hard inclusions made of Hi-Cr cast iron or tungsten carbides in selected parts of the machinery. For example, U.S. Pat. No. 5,439,751 describes an ore pellet cast grate cooler side plate having a bottom surface containing embedded insert made of Hi-Cr cast iron.

U.S. Pat. No. 5,081,774 and U.S. Pat. No. 5,066,546 describe composite casting of an excavator tooth in which the critical wear areas are protected by Hi-Cr cast iron inserts or other material.

U.S. Pat. No. 1,926,770 proposes to insert tungsten carbide items in grey cast iron products.

The aforementioned solutions prove inefficient in protecting sophisticated structures, concave or convex surfaces and super-thick parts or pieces having a variable thickness.

SUMMARY OF THE INVENTION

More specifically, there is provided a wear resistant casting, comprising a matrix and inserts embedded in the matrix; each insert having a form such that a ratio A/B in any mutually perpendicular section that passes through the centre of mass of the insert is comprised between 0.4 and 2.5, and a distance C between two insert is at least two times smaller that a width thereof; the inserts forming at least one grid.

There is further provided a method for manufacturing wear resistant castings, comprising the steps of forming at least one grid of compact elements and inserting at least one grid into a jacket; forming at least one grid comprising compact elements having a form such that a ratio A/B in any mutually perpendicular section that passes through the centre of mass of the insert is comprised between 0.4 and 2.5, and a distance C between two insert is at least two times smaller that a width A, B thereof.

Other objects, advantages and features of the present invention will become more apparent upon reading of the following non-restrictive description of specific embodiments thereof, given by way of example only with reference to the accompanying drawings.

DESCRIPTION OF ILLUSTRATIVE EMBODIMENTS

The present invention is illustrated in further details by the following non-limiting examples.

As illustrated in the FIGS. 1 to 5 of the appended drawings, a casting 10 generally comprises a grid formed of a plurality of inserts 12, embedded in a matrix 14.

The matrix 14 is made of a ductile material, such as ductile ferro alloy for example. The inserts 12 are made of an abrasion and impact resistant material, such as Hi-Cr white cast-iron, for example.

Figure 12A:
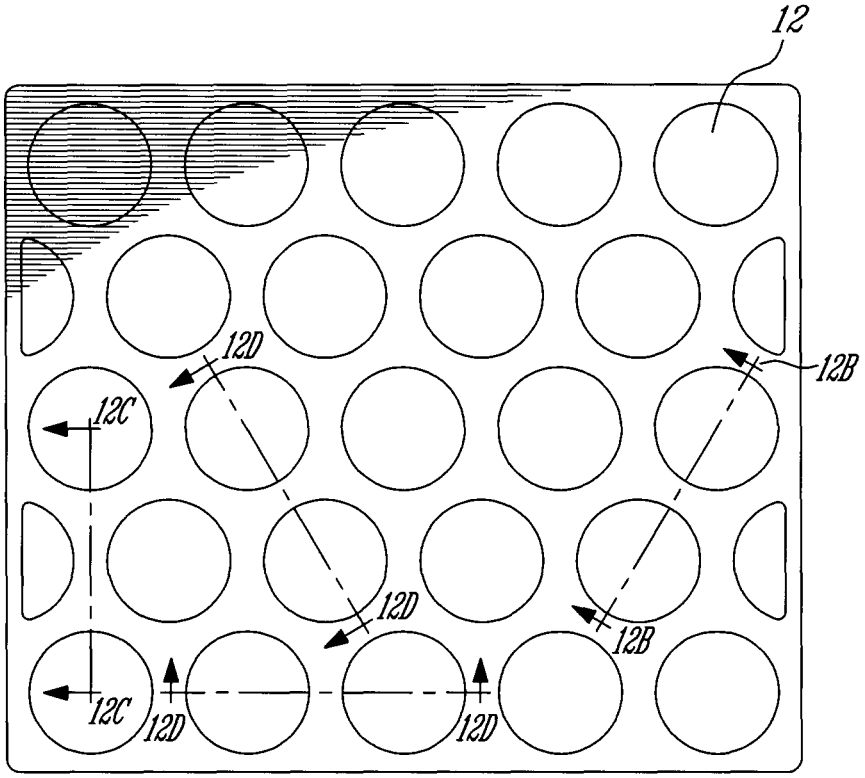
FIG. 12 is a) a schematic top view; b) a first cross section; c) a second section; d) a third section; and e) a grid of a casting according to an embodiment of a first aspect of the present invention.
Figure 12B:
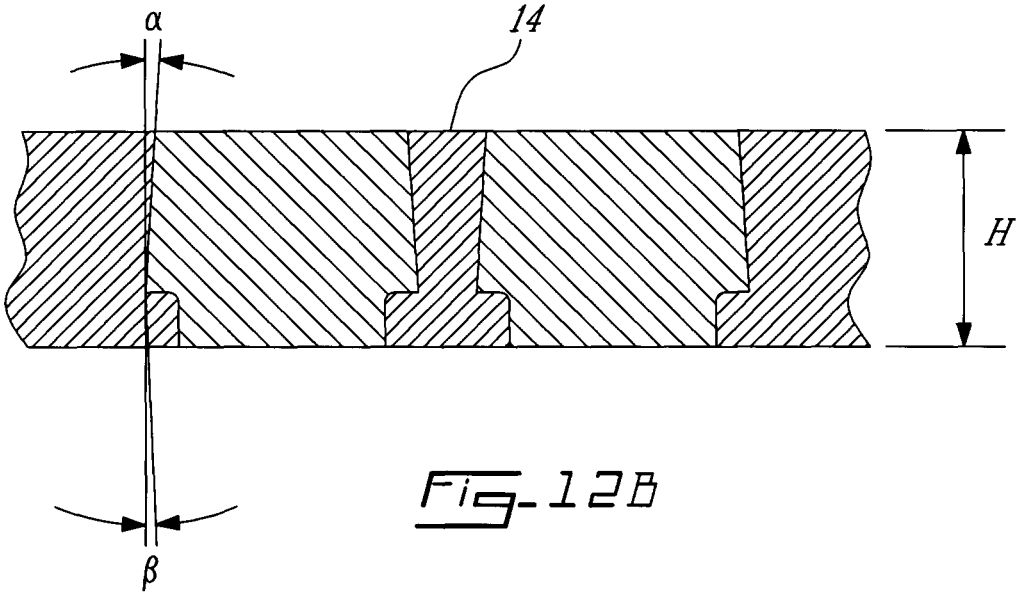
Figure 12C:
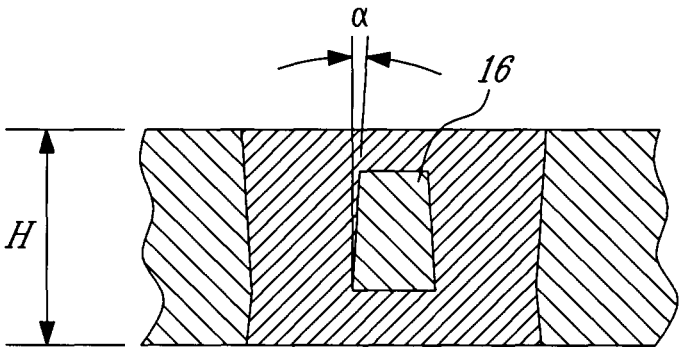
Figure 12D:
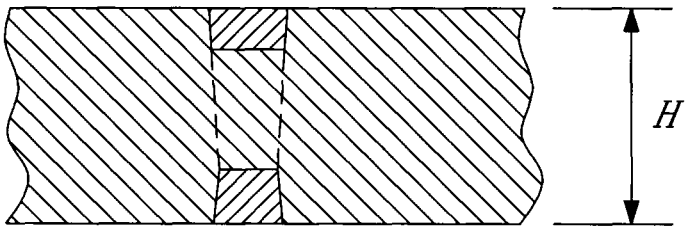
Figure 12E:
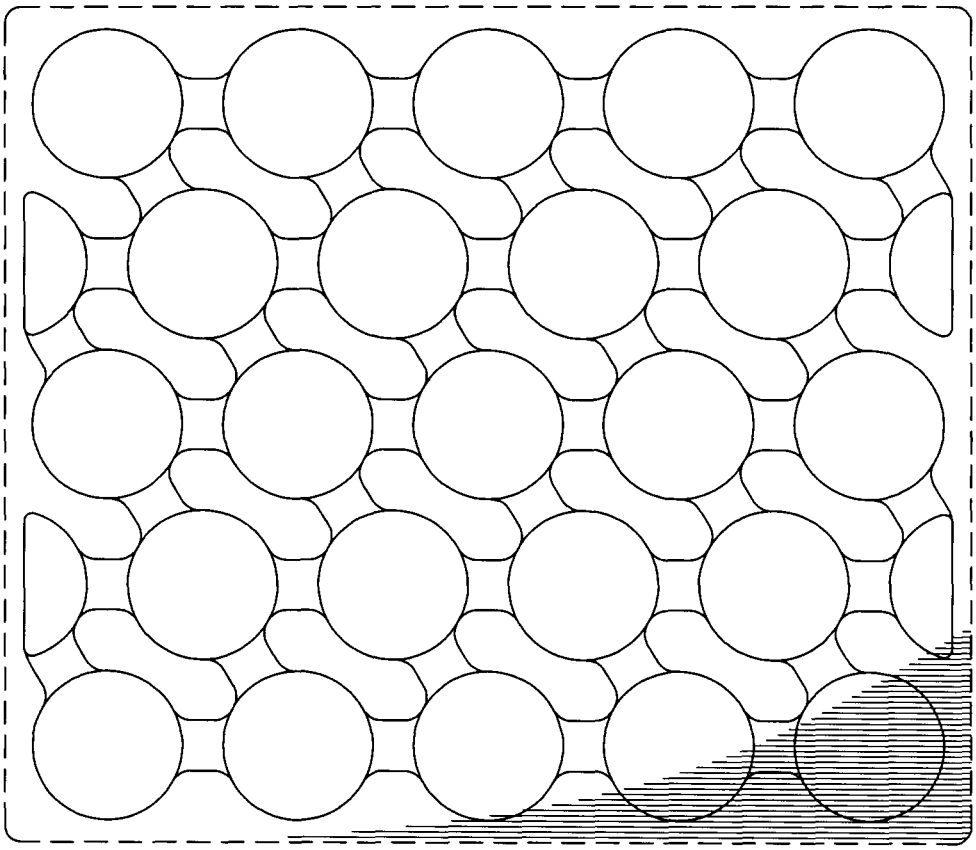

The inserts 12 are compact elements, formed in the plan view as circles (FIGS. 2, 12*a*), triangles (FIG. 1), squares, rectangles, Y or T-forms (FIGS. 6*a-d*), or combinations for example (FIGS. 6*e-h*). In the same plate 10, inserts 12 may have various shapes.

Figure 5A:
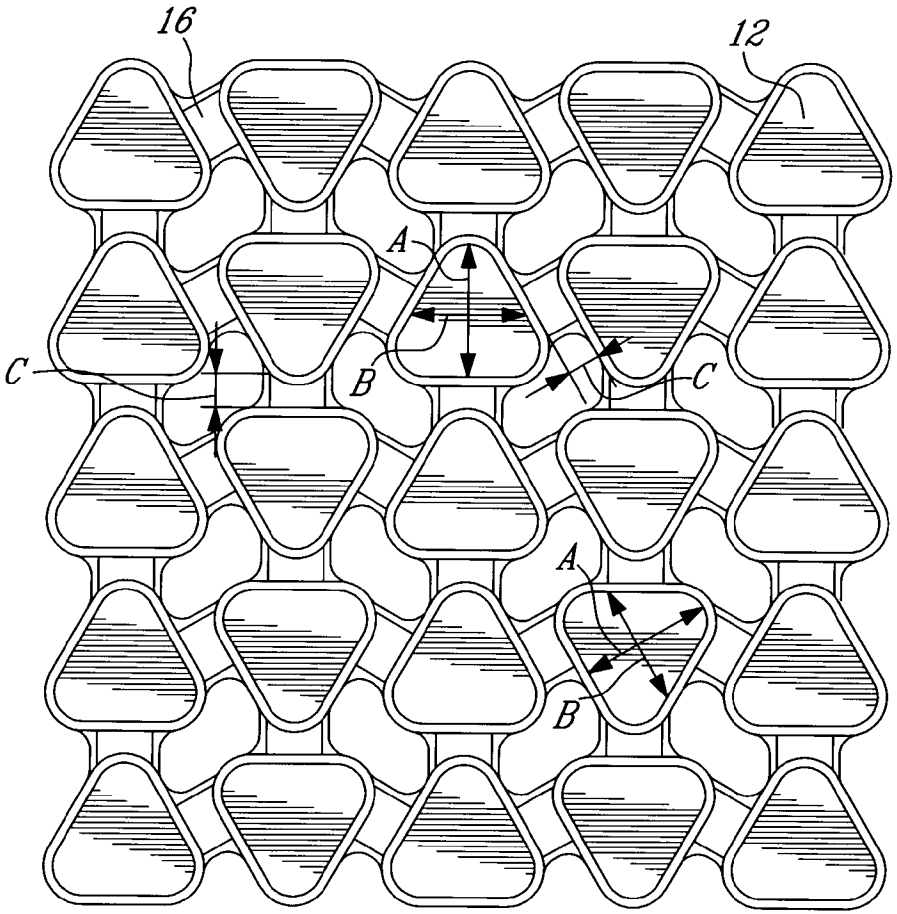
FIG. 5 are views of a grid according to an embodiment of the present invention FIG. 6 illustrate shapes of inserts for a casting according to an embodiment of the present invention.
Figure 5B:
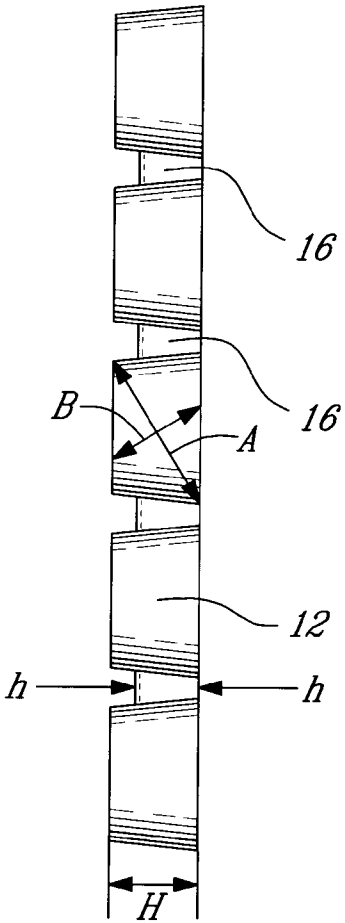
Figure 5C:
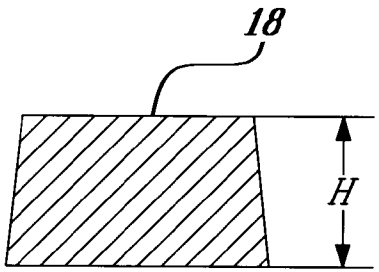
Figure 5D:
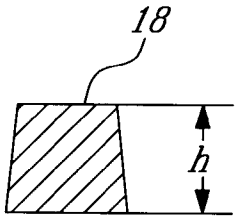
Figure 6A:
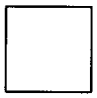
Figure 6B:
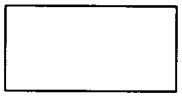
Figure 6C:
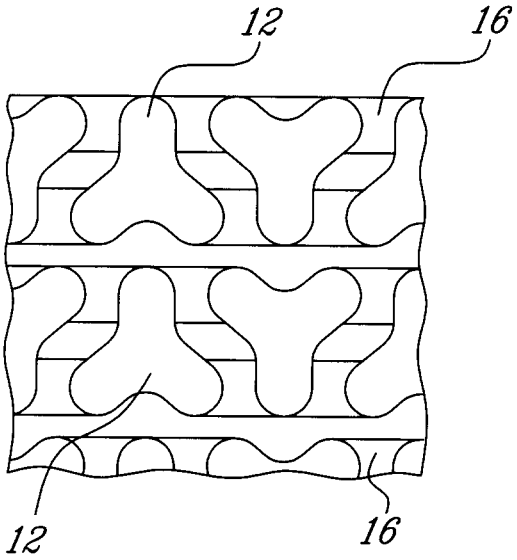
Figure 6D:
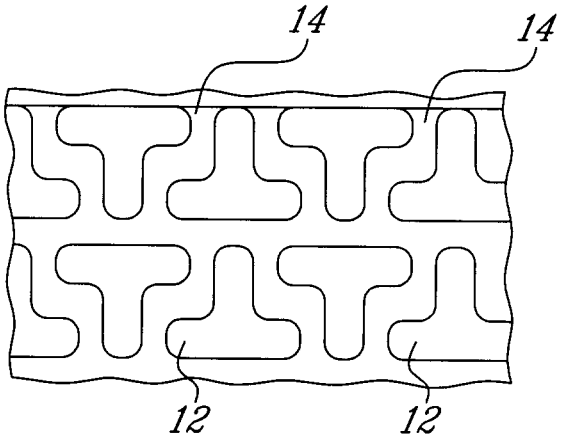
Figure 6E:
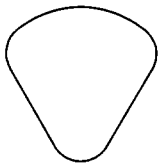
Figure 6F:
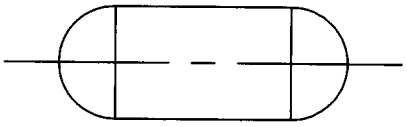
Figure 6G:
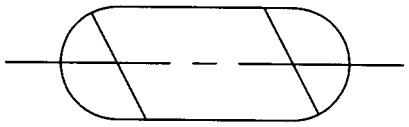
Figure 6H:
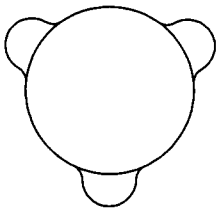

As best seen in FIG. 5*a*, the length to the width ratio (A/B) in any mutually perpendicular section crossing the centre of gravity of a given insert 12 is comprised in the range between 0.4 and 2.5.

Moreover, the distance C between two inserts 12 is at least two times smaller that their width, i.e. A/C>2 and B/C>2 (see FIG. 5 (*a*)), so that the softer matrix material between the inserts is protected by a "shadow effect" meaning that the abrasive material is contacting the displaced top surface of the hard wear resistant inserts 12 mainly. As a result, the wear rate of the softer matrix is quickly stabilized, after an initial accelerated wear, and tends to be basically equal to the wear rate of the hard inserts.

Inserts having a round shape in the plan view (see for example FIGS. 2, 12*a*) provide an increased compactness (A/B=1, FIGS. 2, 12*a*) as well as a high ricochet effect in certain specific conditions. In other conditions, the triangular, rhomboid or rectangular shaped inserts (A/B=0.4-2.5; FIG. 6) may be more suitable since they can be designed and positioned in such a way that their "shadow effect" in the direction of an abrasive mass flow is enhanced and optimized.

Figure 1C:
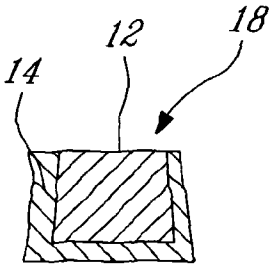
FIG. 1 is a) a schematic top view; b) a first cross section; and c) a second section of a casting according to an embodiment of a first aspect of the present invention.
Figure 1B:
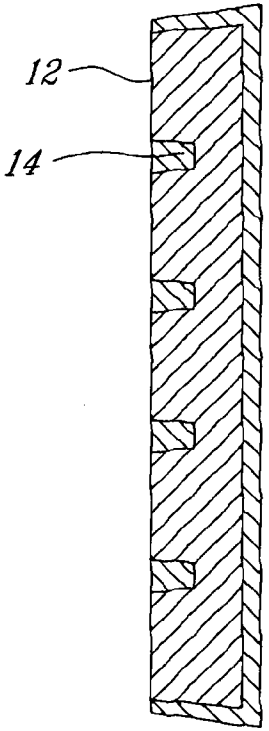
Figure 1A:
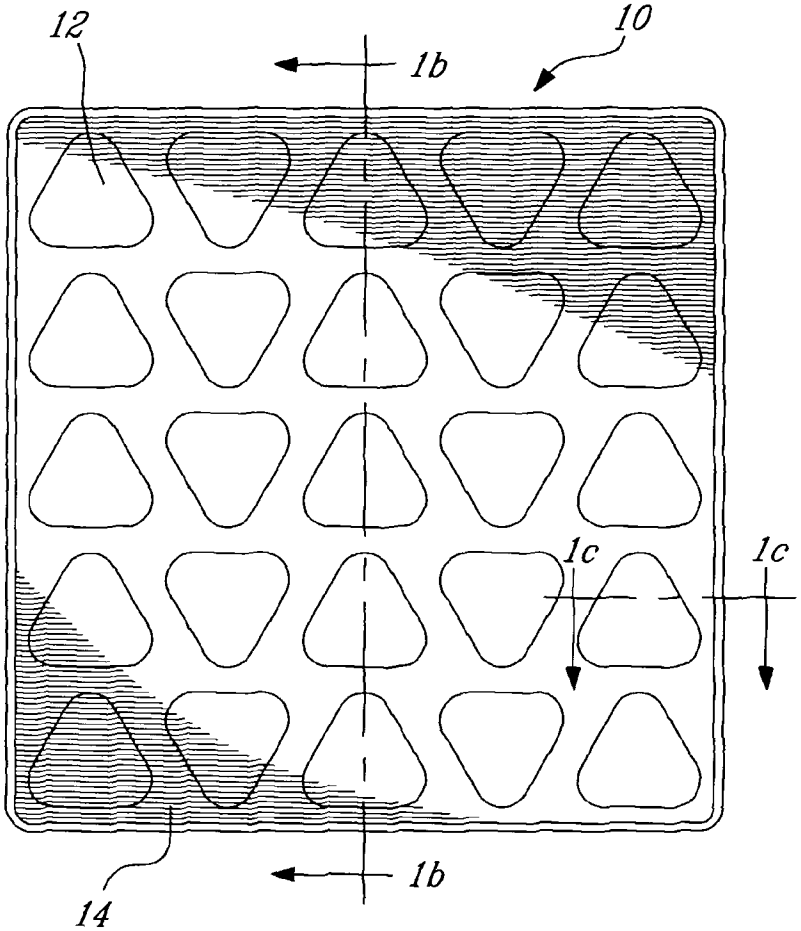

The inserts 12 have a vertical section in the general form of a trapezium having its minor side 18 (see FIG. 5*d*) directed toward the working surface of the plate 10 (see FIG. 1*c*). Such a configuration contributes to further anchor the inserts 12 into the matrix 14, the inserts being thus mechanically prevented against separation from the matrix 14.

Figure 3A:
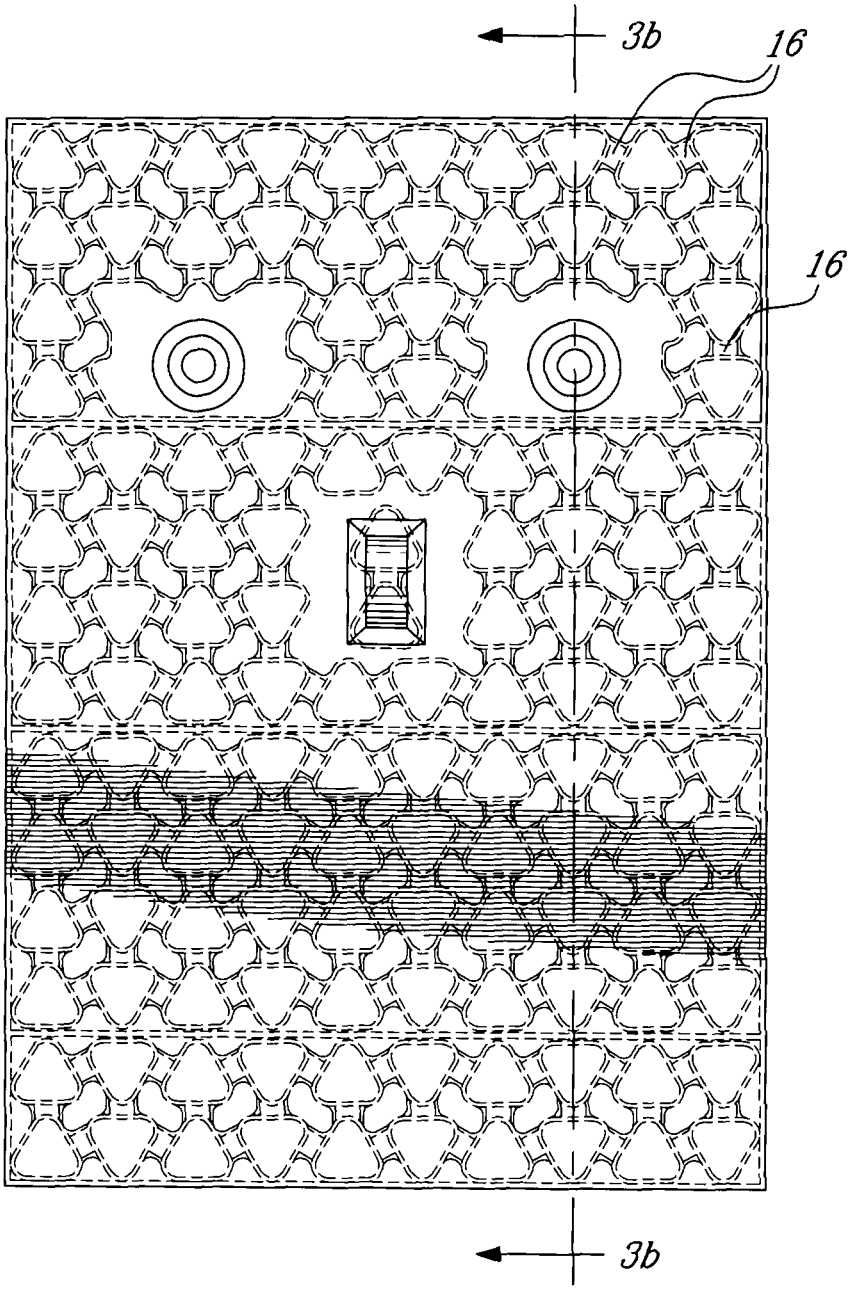
FIG. 3 are views of a casting according to still another embodiment of a first aspect of the present invention.

The inserts 12 may be connected together by bridges 16, as seen for example in FIGS. 3 and 5. As shown in FIGS. 5 (*b*), 5 (*c*), and 5 (*d*) the height (h) of the bridges 16 is inferior to the height (H) of the inserts 12. Such bridges 16, connecting inserts 12 together, protect weaker soft areas of matrix 14 between the inserts 12 against abrasive and impact wear. The height of the bridge (h) being inferior to the height of the insert (H) is also found to facilitate the flow of the matrix metal around the inserts 12 during the casting process, as will be discussed herein below.

Using bridges allows increasing the total contact area between the inserts 12 and the matrix 14 (usually 2-fold and up to 5-fold ratio), as compared to Abreco™ laminated plates or Brospec™ hard facing plates, for example, which results in a higher integrity of the casting throughout its entire thickness.

Furthermore, using bridges allows to manufacture a number of inserts as one solid member, which results in significant savings of production time and cost by dealing with one solid member only instead of a plurality of members during the molding process described hereinafter.

Figure 2A:
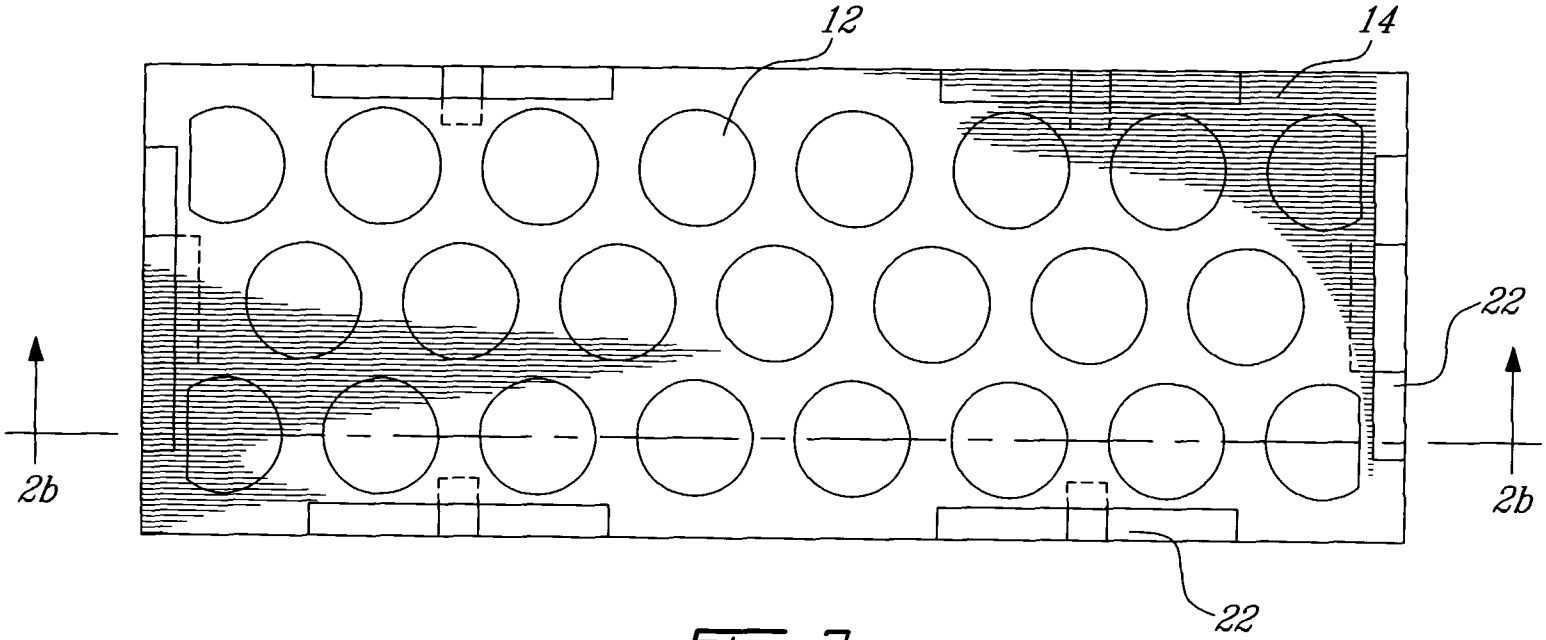
FIG. 2 is a) a schematic top view and b) a section view of a casting according to another embodiment of a first aspect of the present invention.
Figure 2B:
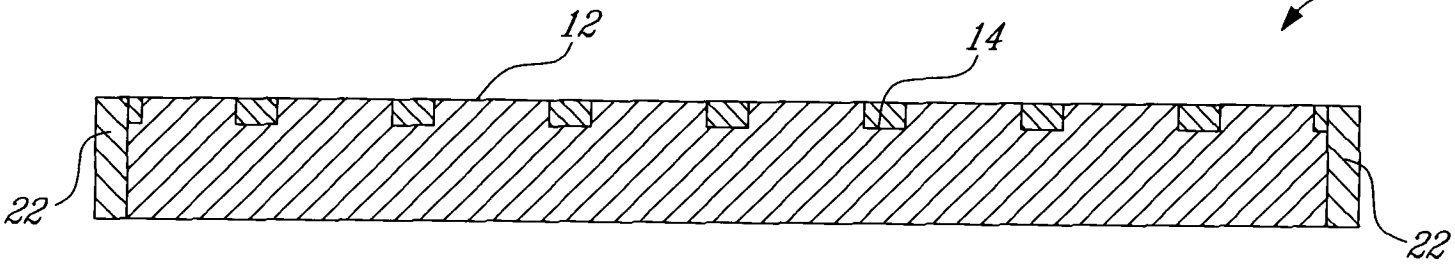
Figure 3B:
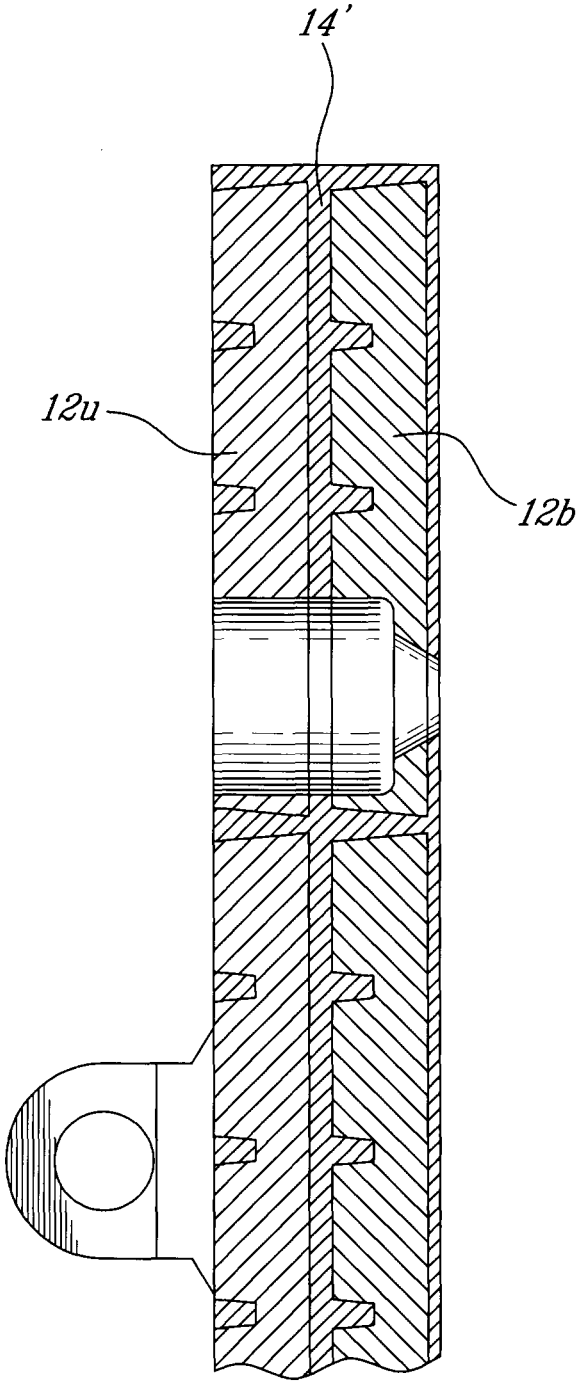
Figure 4A:
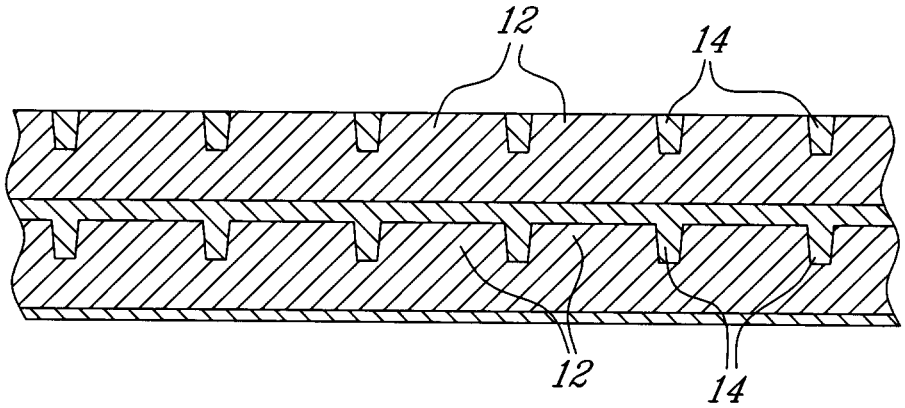
FIG. 4 are sections of castings according to further embodiments of a first aspect of the present invention.
Figure 4B:
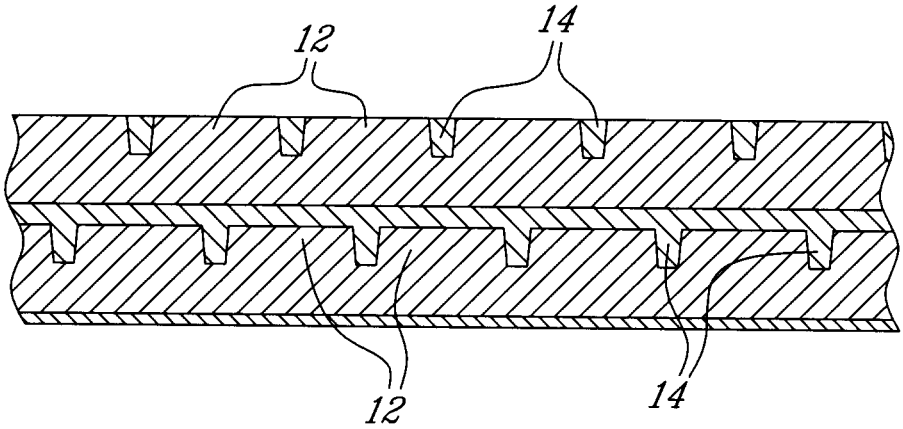

The inserts 12 are arranged to form grids located in one or more levels, as illustrated in FIGS. 1, 2, 3 and 4. In FIG. 3 (*b*) for example, a first bottom grid is formed by bottom inserts 12*b*, and a second upper grid is formed by upper inserts 12*u*. The grids, thus located on various levels within the thickness of the plate 10, are separated by a layer 14' of the matrix, as shown in FIG. 3 (*b*). They may be coaxial in the plan view (see FIGS. 3*b* and 4*a*) or displaced laterally one versus the other in the plan view (see FIG. 4*b*).

Such a multilevel layout of wear resistant grids is found to drastically improve the mechanical properties of the casting, such as strength, especially when it's 3" thick and over for example, as a result of a 3-dimensional honeycomb matrix structure that is created by occurrences of interconnecting channels throughout the thickness of the casting.

Figure 7:
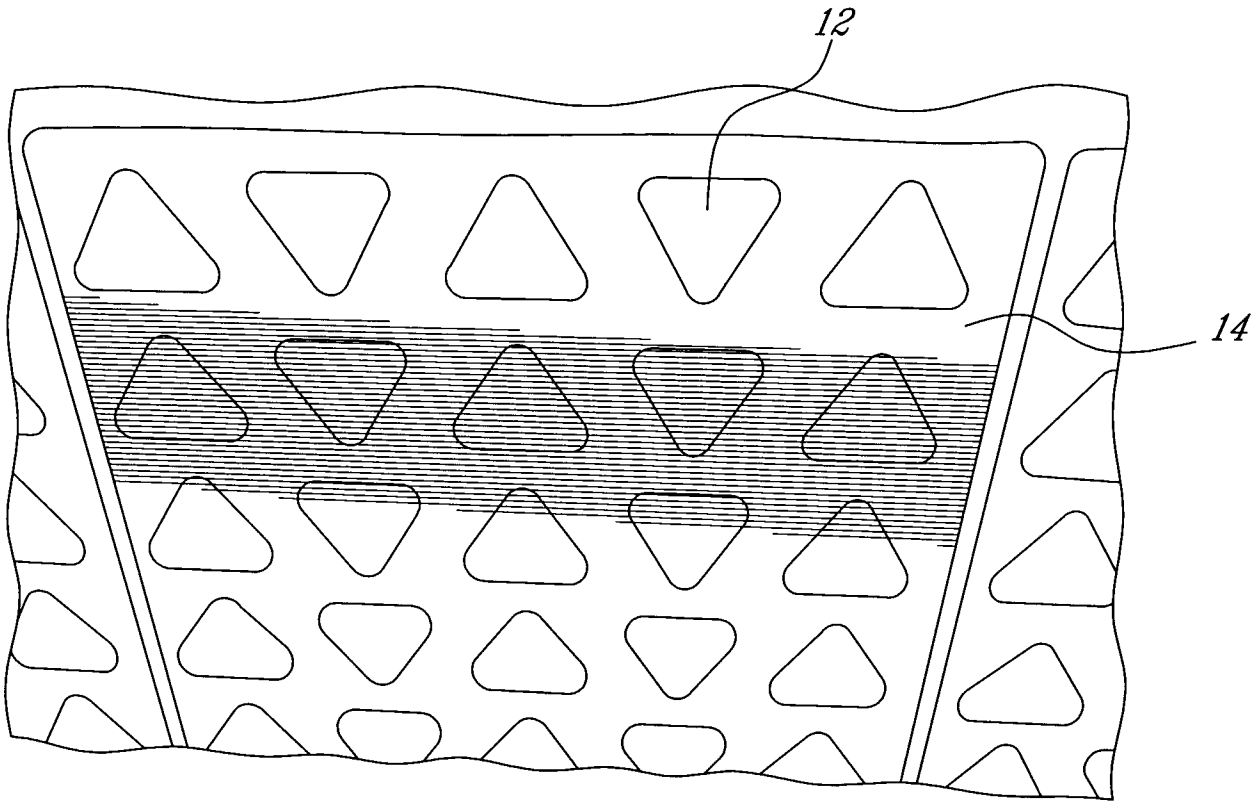
FIG. 7 is a perspective top view of the FIG. 1 casting.

The inserts 12 may be visible when flush with the working surface of the plate (See FIG. 7).

Alternatively, they may be hidden under the working surface, the wear resistant grid being completely covered by a thin layer of the matrix ductile material. In this case, the thin layer of the matrix ductile material acts as a thermal resistance, and allows higher cooling rates during the heat treatment procedures, described hereinafter, as compared to the case of traditional wear resisting materials. Such feature has proved interesting when thick section castings (3" thick and over) are manufactured, for example.

The plan view surface ratio, defined as the ratio of the total working surface of all inserts 12 and bridges 16 to the total working surface of the plate 10, is comprised in the range between 25% and 80%. The volumetric ratio (the volume of all inserts 12 and bridges 16 to the total volume of the plate 10) is comprised in the range between 20 and 75%.

The compound wear resistant castings, as described above, may be used to make liners for chutes, loader and excavator buckets, draglines, mills, crushers, for example, and could be used in the mining, cement, road building, construction and similar industries. Under a load, the inserts 12 distribute the action of a wear and/or impact force over a larger area, thereby increasing wear resistance, especially in cases when a combined abrasive/impact action occurs. Bridges between inserts protect softer interior spaces of the plates from excessive wear. The ductile matrix serves as integrating the inserts and allows an easy installation of wear resistant castings on surfaces to be protected, by welding, for example.

Figure 8A:
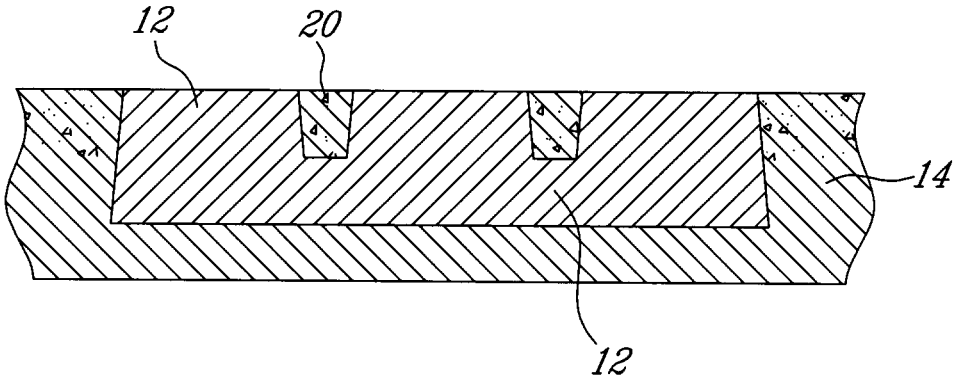
FIG. 8 shows inclusions in a casting according to an embodiment of the present invention.
Figure 8B:
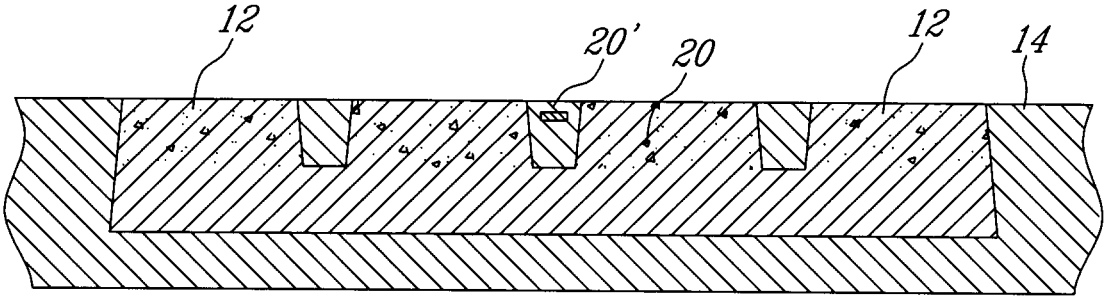
Figure 8C:
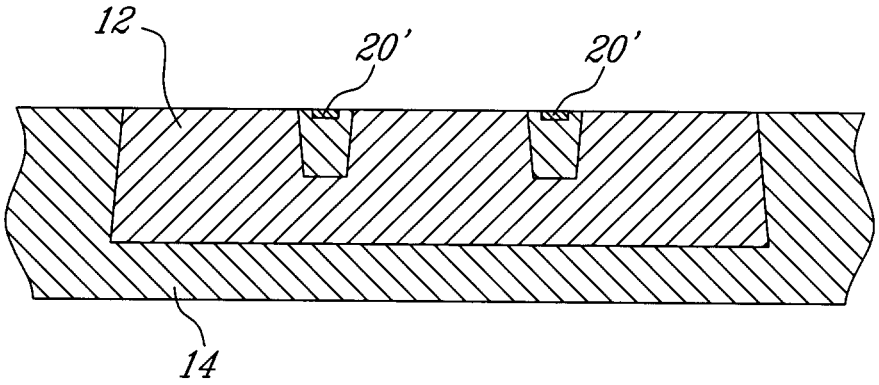

In especially harsh conditions, the casting may be additionally reinforced by adding carbide inclusions 20, such as WC—Co or TiC—WC—Co for example, at the surface (FIG. 8*c*) or in the volume of the insert 12 itself and/or into the spaces in between inserts (FIGS. 8*b* and 8*a*), to combine the extremely high wear resistance of the Cr, W, and V carbides with the properties of the material of the matrix.

The matrix 14 may alternatively be made of a wear resistant material such as Hadfield steel or Hi-Cr cast iron, or plastic material such as rubber, polyurethane or Kevlar™ for example, instead of usual ductile ferrous alloy. In this case the weldability is provided by mild steel back plate 25 (FIG. 10) and/or steel brackets 22 (FIG. 2).

A method for making wear resistant compound castings according to an embodiment of a second aspect of the present invention will now be described.

The method generally comprises forming grids (step 100) and casting the matrix (step 120).

The grid comprises a plurality of compact elements. It is made usually out of a wear resistant cast iron comprising (mass volume, %) C between 1.7 and 3.6; Si between 0.3 and 1.7; Mn between 0.3 and 3.5; Cr between 13 and 33; Ni up to 1.0; Mo up to 1.0; Cu up to 1.0; V up to 1.0; Zr between 0.02 and 0.2; B up to 0.1. The precise chemical composition is selected as a function of specific working conditions of a given application, in particular in relation to the abrasive, corrosion or impact wear components of the application.

When the grid is cast in the mould, at least one surface of the grid is formed under the condition that: $b>9.5$ $J/m^2*K*sec^{1/2}$, where $b=[\lambda*c*\gamma]^{1/2}*10^3$, $\lambda$ is the specific heat conductivity of the material in W/m*K, c is the specific heat in W/kg*K and $\gamma$ is the density of the material of the mould in $kg/m^3$. Such conditions allow obtaining a target microstructure of the material of the grid and an adequate quality of the casting. As far as chromium carbide crystals are concerned, their size and dispersion in the base material as well as their crystal type are carefully controlled. Average size of chromium carbides $Cr_7C_3$ is less than 6 μm.

The inserts 12 may be made of tool steel, such as, for example, D2, D4, D7, or A11, and the connecting bridges may be made of mild steel.

Figure 11A:
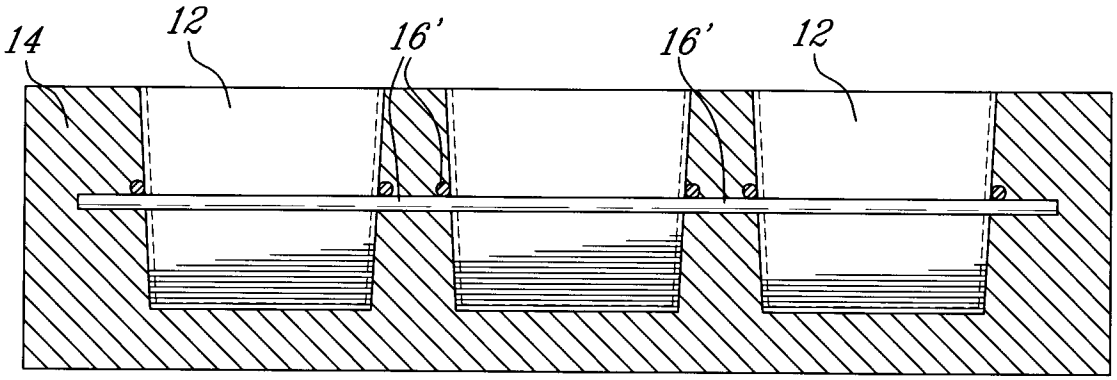
FIG. 11 is a) a cross section view; b) a schematic top view section of a casting according to an embodiment of a first aspect of the present invention.
Figure 11B:
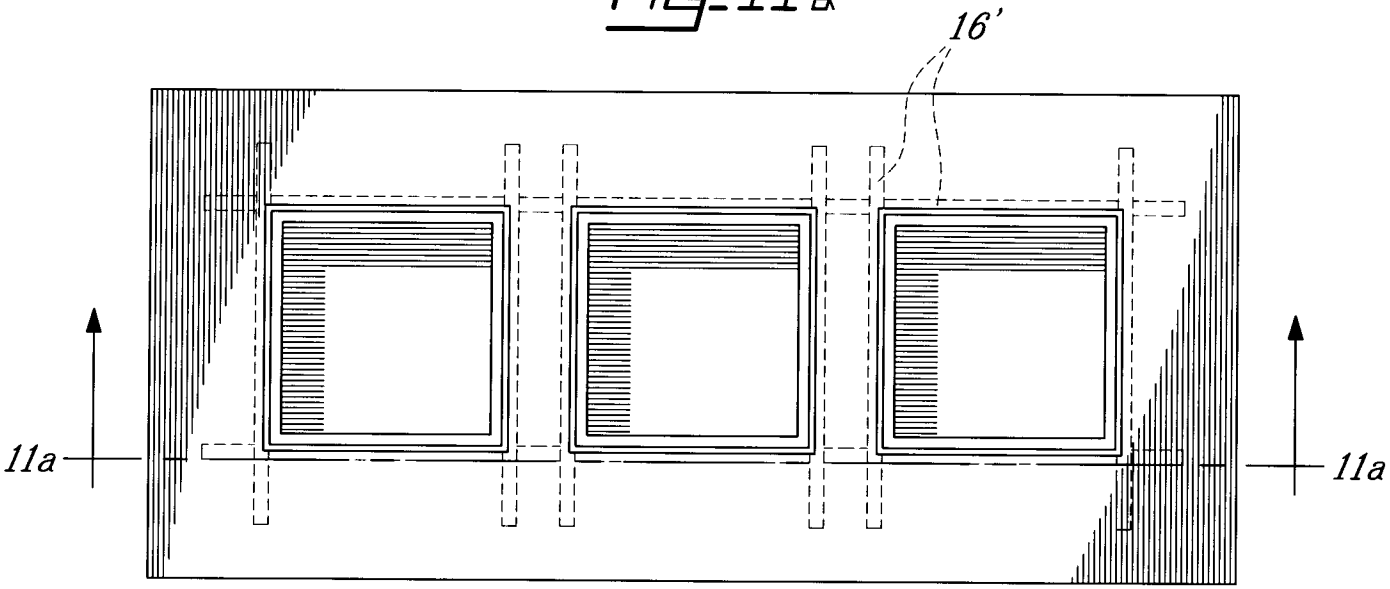

In some cases, when the grid is produced by other methods that casting, such as rolling or forging, for example, the inserts are connected to each other by mechanical means such as, for example, wire mesh (FIG. 11).

The inserts 12, the matrix 14, and the compound plate itself may have the same height H (FIG. 12). In such cases, the ratio $H_{insert}/H_{plate}=1$, and the wear resistant material of inserts is present along the whole height of the plate. The bridges 16 may then be located at about mi-height of the inserts 12 (FIGS. 12*c, d, e*). A ratio of the total working surface of the inserts 12 and the bridges 16 (FIGS. 12*b, a, d*) over a working surface of the casting (FIG. 12*a*) may be up to 80%. A ratio of a total volume of the inserts over a volume of the casting may be up to 75%.

Figure 10:
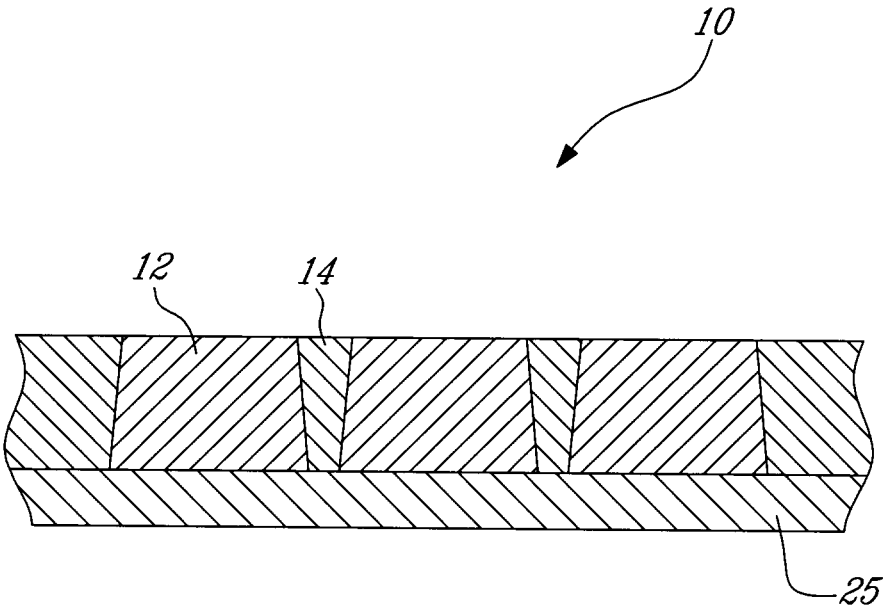
FIG. 10 shows a casting having a back plate, according to an embodiment of a first aspect of the present invention.

In step 120, the grid thus formed is placed into a mold, together with inclusions of WC—Co, TiC—WC—Co if any, as described hereinabove, and/or steel welding brackets 22 shown in FIG. 2 and/or back plate 25 shown in FIG. 10 and intended to facilitate the welding of the casting, for example. Bridges connecting the inserts, which played the role of metallurgical gates during the grid casting, now provide intricate flow patterns for the melt matrix alloy, thereby improving anchorage of the wear resistant grid into the matrix.

The mold is then filled with a melted or plastic material, selected for the matrix according to target properties, between low carbon or low alloy steel, Mn-steel, Hi-Cr cast iron, ductile iron, Al-alloy, plastic material such as rubber, polyurethane or Kevlar™ for example.

The matrix material thus fills voids around the inserts and bridges, thereby reinforcing and completing the wear resistant casting.

When the inserts are connected with bridges, the temperature of the interface between the bridges and the matrix is drastically increased during the matrix cast, due to their relatively low cross section which improves the diffusive bond between the grid of inserts and the matrix. An optimal bond is achieved when a partial melting of the grid surface occurs, leading to truly metallurgical bond.

Using bridges also provides an additional degree of freedom in the design of the wear resistant plate, so that optimized mechanical properties of the plate may be achieved in the direction of the abrasive material flow in target applications.

The casting may further be heat treated, at a temperature comprised in the range between 820° C. and 1150° C., and subsequently cooled at a rate that prevents the creation of diffusion/transformation of the austenite in the body of the inserts, i.e. with $V_c$ ($T_q$-550° C.) comprised in the range between 20 and 40° C./min, where $V_c$ is the cooling rate in ° C./min, $T_q$ is the quenching temperature in ° C.

In case when matrix 14 is made of a plastic material such as rubber, polyurethane or Kevlar™ for example, instead of usual ductile ferrous alloy, grids and inserts may be heat-treated as described above before they are placed into a mould.

A target microstructure of the grid after such heat treatment comprises carbide particles having a microstructure of extremely hard eutectic chromium carbides dispersed in a martensite matrix with a small amount of unstable austenite. Thus, the grid provides high wear resistance, while the more ductile steel matrix provides impact-resistance and welding properties.

In the final casting, the inserts combine optimized chemical composition, shape, and orientation, as well as a distribution throughout each casting, yielding a high resistance to intensive abrasive wear.

The present compound wear-resistant casting may be used to protect machinery surfaces from abrasive and/or impact wear, in application fields such as mining, cement, construction and other industries where crushing, grinding, and transport of abrasive materials are necessary.

In after-market applications, the present castings are fixed by welding on the surfaces to be protected, against abrasive or gouging wear by mineral ores, rocks, iron ore pellets or other abrasive materials.

Figure 9A:
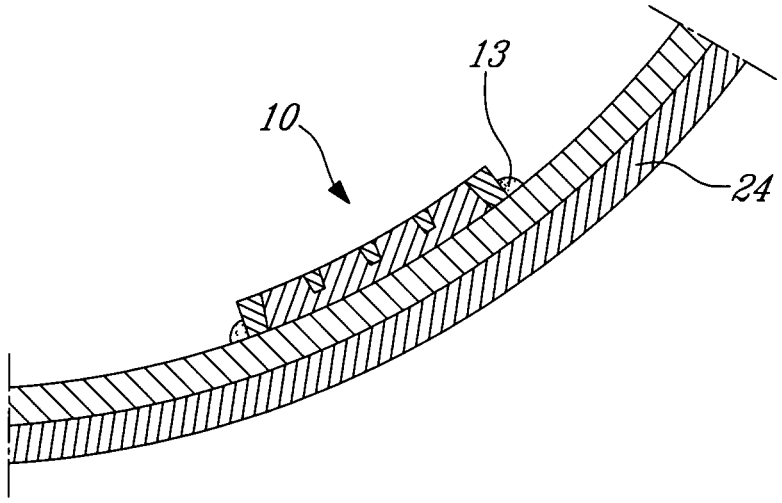
FIG. 9 show a) a concave, b) a convex, and c) a concave-convex plate according to an embodiment of the present invention.
Figure 9B:
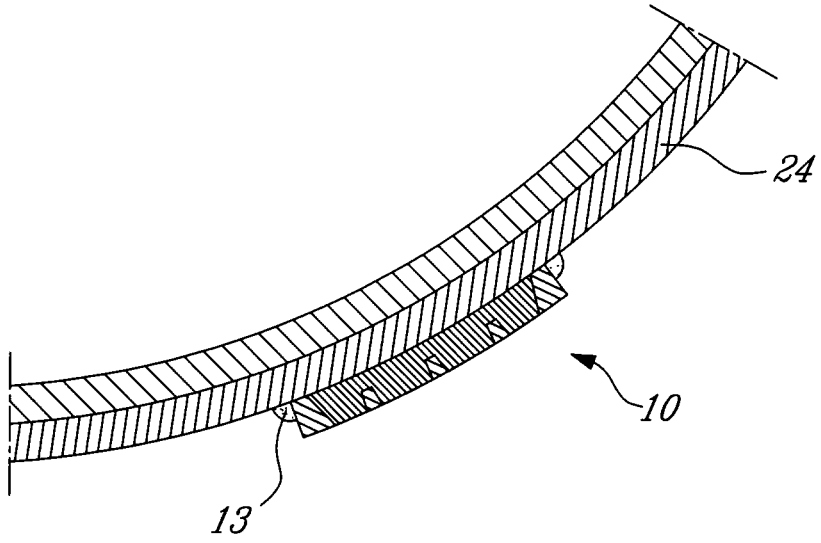
Figure 9C:
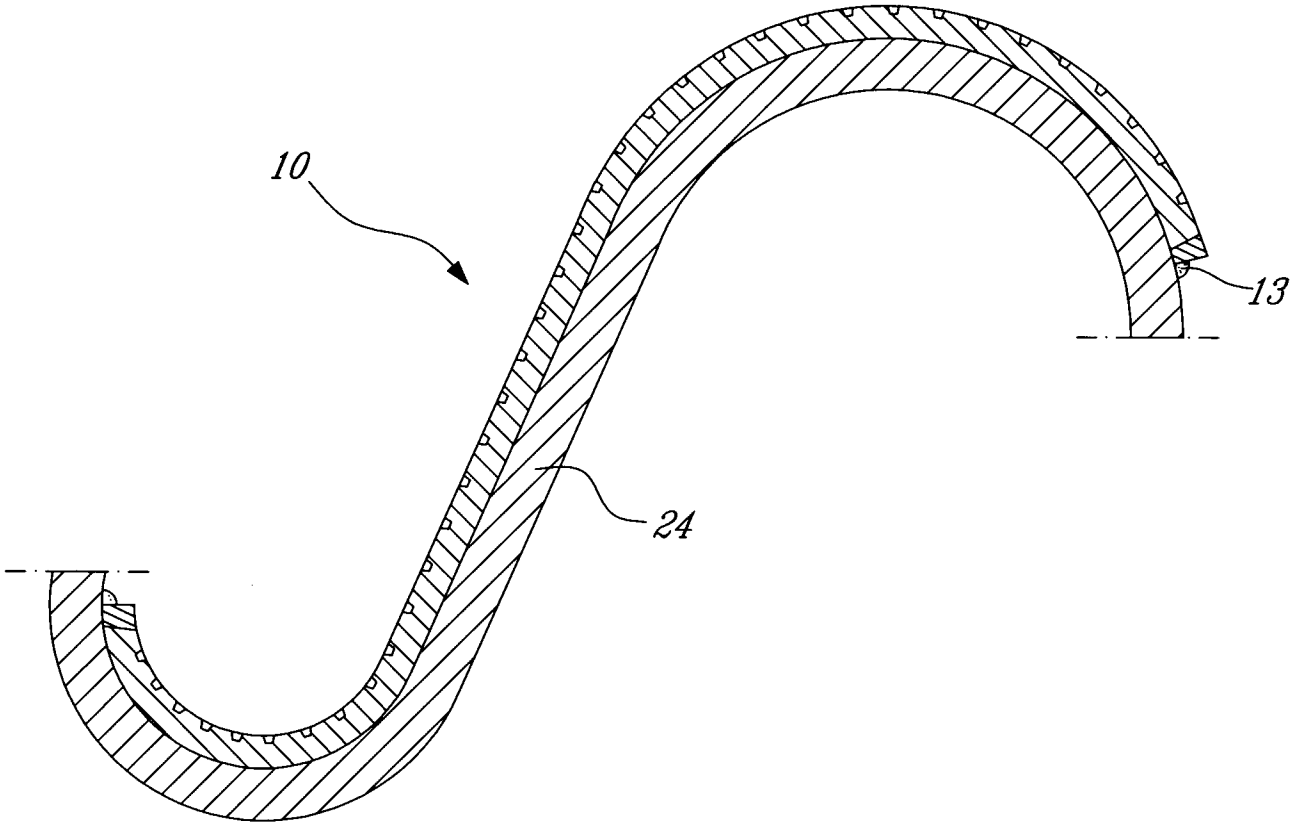

The casting 10 may have a concave, convex, or concave-convex working surface, in order to be adapted to various shapes of machine parts being protected. FIG. 9*a*, for example, illustrates a concave casting 10 positioned by welding 13 to a concave surface 24, whereas FIG. 9*b* illustrates a convex casting late 10 positioned by welding 13 to a convex surface 24.

The compound castings of the present invention may be used in machine components and equipment used in open-pit mining, transportation, crushing and concentration plants as well as in coalmines, in combined abrasive/impact wear conditions. The compound castings of the present invention may be mounted on working surfaces of mining equipment, such as discharge stations of a wheel extractor in open pit coal mining, conveyer discharge devices, hoppers, digger buckets, caterpillar loader buckets, etc. . . . .

The present grids show superior performance in comparison with high-Chromium cast iron (15% Cr, 3% Mo) used in current brazed laminated plates, used extensively in Canadian mining industry.

The present compound castings increase the longevity of protected surfaces by 30% to 90%, as compared to standard protection means, such as: hot rolled steel plates, railroad rails, high-manganese steel bars or wear-resistant surfaces laid by electrical deposition.

Compared to other methods of protection against intensive abrasion and impact wear, the present invention thus allows for higher design and technological flexibility, since the chemical composition and the microstructure of the inserts may be adjusted to a target values in accordance with specific wear conditions. Moreover, the impact resistance achieved is significantly higher than when using monolithic high chromium cast irons or high chromium cast irons brazed to the backing steel plates. Also, the achieved wear-resistance is significantly superior to that of low alloy steels with martensite microstructure or the high-manganese steels of Hadfield group.

Remarkably, because the present compound castings have excellent welding properties, there's no need to use expensive materials or methods for fitting it to the protected surface, as for example is in the case of martensite steels, extensively used in the mining industry.

Although the present invention has been described hereinabove by way of specific embodiments thereof, it can be modified, without departing from the spirit and nature of the subject invention as defined in the appended claims.

The invention claimed is:

1. A wear resistant casting for protecting a working surface of a part, comprising at least one solid member embedded within the thickness of a matrix, said solid member comprising first compact elements connected together by first bridges, said bridges having a height (h), each compact element having a length (A) and a width (B) such that a ratio A/B in any mutually perpendicular section that passes through the centre of mass of each compact element is comprised between 0.4 and 2.5, and a distance (C) between two adjacent compact elements is such that a ratio A/C is greater than 2 and a ratio B/C is greater than 2;

wherein said casting has a height ($H_{plate}$), said compact elements have a height ($H_{insert}$), said compact elements extending from within said matrix over at least part of said height ($H_{plate}$) of said casting to a top surface of said casting, said casting being adapted to be fixed to the working surface of the part to be protected by a surface of said casting opposite said top surface of said casting.

2. The wear resistant casting of claim 1, wherein each compact element has a vertical section in a form of a trapezium, a minor side of the trapezium being directed toward the top surface of the casting.

3. The wear resistant casting of claim 1, wherein the height (h) of said bridges is inferior to the height (H) of said compact elements.

4. The wear resistant casting of claim 1, wherein a ratio of a total working surface of the compact elements over the top surface of the casting is comprised in a range between 25 to 80%.

5. The wear resistant casting of claim 1, wherein the height (h) of said bridges is inferior to the height (H) of said compact elements, a ratio of the total working surface of the solid member over the top surface of the casting is comprised in a range between 25 to 80%.

6. The wear resistant casting of claim 1, wherein the height (h) of said bridges is inferior to the height (H) of said compact elements, a ratio of a total volume of the solid member over a volume of the casting is comprised in a range between 20 and 75%.

7. The wear resistant casting of claim 1, wherein said compact elements, are formed in a plan view as ones of: circles, triangles, squares, rectangles, Y-, and T-forms.

8. The wear resistant casting of claim 1, wherein said compact elements have a shape formed by a combination of at least one of: circles, triangles, squares, rectangles, Y-, and T-forms.

9. The wear resistant casting of claim 1, comprising a second solid member embedded within the thickness of the matrix, said second solid member comprising second compact elements connected by second bridges, said second solid member being located below said first solid member in said matrix.

10. The wear resistant casting of claim 1, comprising a second solid member embedded within the thickness of the matrix, said second solid member comprising second compact elements connected by second bridges, said second solid member being located below said first solid member in said matrix and separated from said first solid member by a layer of the matrix along the height of the casting.

11. The wear resistant casting of claim 9, wherein said first and second solid members are one of: i) coaxial along the height of the casting and ii) displaced laterally one versus the other along the height of the casting.

12. The wear resistant casting of claim 1, having one of: i) a concave; ii) a convex and iii) a concave-convex form.

13. The wear resistant casting of claim 1, wherein said first compact elements are made of wear resistant cast iron comprising, in % mass volume: C between 1.7 and 3.6; Si between 0.3 and 1.7; Mn between 0.3 and 3.5; Cr between 13 and 33; Ni up to 1.0; Mo up to 1.0; Cu up to 1.0; V up to 1.0; Zr between 0.02 and 0.2; B up to 0.1.

14. The wear resistant casting of claim 1, further comprising, at a perimeter thereof, at least one steel insert, embedded in said matrix.

15. The wear resistant casting of claim 1, further comprising carbide inclusions.

16. The wear resistant casting of claim 1, wherein said matrix is made in a ductile ferrous alloy.

17. The wear resistant casting of claim 1, wherein said matrix is made in a wear resistant ferrous alloy.

18. The wear resistant casting of claim 1, wherein said matrix is made in one of: rubber, polyurethane and paramid synthetic fiber.

19. The wear resistant casting of claim 17, further comprising at least one of: i) steel brackets and ii) steel back plate.

20. The wear resistant casting of claim 1, wherein said first compact elements comprise one of: tool steel, WC—Co, TiC—WC—Co, and said bridges comprise mild steel.

21. The wear resistant casting of claim 18, further comprising at least one of: i) steel brackets and ii) steel back plate.

* * * * *